US008382247B2

(12) United States Patent
Kobayashi et al.

(10) Patent No.: US 8,382,247 B2
(45) Date of Patent: Feb. 26, 2013

(54) LIQUID EJECTING HEAD AND LIQUID EJECTING APPARATUS

(75) Inventors: Hiroyuki Kobayashi, Shiojiri (JP); Hiroshige Owaki, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 96 days.

(21) Appl. No.: 13/008,628

(22) Filed: Jan. 18, 2011

(65) Prior Publication Data

US 2011/0234700 A1 Sep. 29, 2011

(30) Foreign Application Priority Data

Mar. 25, 2010 (JP) ..... 2010-071121

(51) Int. Cl.
*B41J 2/14* (2006.01)
*B41J 2/16* (2006.01)

(52) U.S. Cl. ..... 347/47; 347/71

(58) Field of Classification Search ..... 347/20, 347/40, 42, 43, 49, 67, 84–86
See application file for complete search history.

(56) References Cited

U.S. PATENT DOCUMENTS

2005/0046668 A1 3/2005 Owaki

FOREIGN PATENT DOCUMENTS

JP 2005-096419 4/2005

*Primary Examiner* — Thinh Nguyen
(74) *Attorney, Agent, or Firm* — Workman Nydegger

(57) ABSTRACT

A liquid ejecting head includes a plurality of head bodies each having a nozzle plate, a flow channel forming substrate having a plurality of pressure generating chambers that communicate with the plurality of nozzles and a manifold that communicates with the plurality of pressure generating chambers, and pressure generating, and a fixation plate having an exposure aperture formed so that the plurality of nozzles are exposed therethrough and on which the plurality of head bodies are fixedly positioned, wherein the edges of the exposure aperture formed on the fixation plate are located in a region opposite the manifold, and a depression is formed on a side of the fixation plate facing the nozzle plate by depressing the edges of the exposure aperture in the region opposite the manifold.

12 Claims, 8 Drawing Sheets

LIQUID EJECTING HEAD AND LIQUID EJECTING APPARATUS

The entire disclosure of Japanese Patent Application No: 2010-071121, filed Mar. 25, 2010 are expressly incorporated by reference herein.

BACKGROUND

1. Technical Field

The present invention relates to a liquid ejecting head which includes a plurality of head bodies that eject liquid droplets and a fixation plate on which the plurality of head bodies are fixedly positioned, and a liquid ejecting apparatus which includes the liquid ejecting head.

2. Related Art

Liquid ejecting heads are known that eject liquid droplets through nozzles by means of pressure applied to liquid by pressure generating means such as piezoelectric elements and heat generating elements. Such liquid ejecting heads typically include ink jet recording heads that eject ink droplets.

JP-A-2005-096419 discloses, for example, an ink jet recording head (unit) including a plurality of head bodies each having a nozzle plate in which nozzle orifices are formed by drilling so that ink droplets are ejected through the nozzle orifices, and a flow channel forming substrate having pressure generating chambers that communicate with the nozzle orifices and flow channels such as reservoirs (communication sections) that communicate with the pressure generating chambers, and a fixation plate on which the plurality of head bodies are fixedly positioned.

In this configuration, the fixation plate is provided with exposure apertures so that the nozzle orifices of the respective head bodies are exposed therethrough. The exposure apertures are formed by stamping the fixation plate made of a metallic plate. Therefore, projections (so-called burrs) are produced, which protrude from one side of the fixation plate around the edges of the exposure aperture. Typically, the projections are formed to protrude toward the nozzle plate. This is because the projections may cause a problem in wiping the nozzle plate surface, if they protrude toward the target ejection medium, such as a recording sheet, which is arranged opposite the nozzle plate.

Moreover, the projections on the fixation plate are formed to engage with the metallic nozzle plate so as to provide electrical conduction between the projections and the nozzle plate, thereby allowing static electricity on the nozzle plate to be discharged via the fixation plate.

In terms of wiping the nozzle plate surface, larger exposure apertures are preferred. Specifically, the edges of each exposure aperture are preferably located outside the manifolds (reservoirs), which are formed in the flow channel forming substrate.

On the other hand, in terms of securely bonding the fixation plate and the head bodies, smaller exposure apertures are preferred in order to ensure a sufficient area for bonding of the fixation plate and the head bodies. Specifically, the edges of the exposure apertures are preferably located inside the manifolds (reservoirs), which are formed in the flow channel forming substrate.

Considering these balances, the edges of the exposure apertures need to be placed in the regions opposite the manifolds (reservoirs). That is, with the edges of the exposure apertures being disposed in the regions opposite the manifolds, it is possible to provide good wiping over the nozzle plate surface and ensure a sufficient bonding strength between the fixation plate and the head bodies.

However, in this configuration, a problem may occur in that the nozzle plate may be delaminated from the flow channel forming substrate during the manufacturing process. The manifold (communication section) formed in the flow channel forming substrate has a relatively wide space which communicates with a plurality of pressure generating chambers and has one side thereof formed by the nozzle plate. Accordingly, with the projections being formed on the fixation plate as mentioned above, the projections cause a force to be applied on the nozzle plate in the regions opposite the communication sections such that the force acts toward the inside of manifolds during bonding of the head bodies to the fixation plate, while they cause a force to be applied on the nozzle plate in the regions around the manifolds such that the force acts in the opposite direction. That is, a force acting in a direction in which it causes the nozzle plate to be delaminated from the flow channel forming substrate is applied on the nozzle plate outside the regions where they oppose the manifolds. As a result, the nozzle plate may be delaminated from the flow channel forming substrate.

In addition, even if the nozzle plate is not delaminated from the flow channel forming substrate during the manufacturing process, the nozzle plate may be gradually delaminated from the flow channel forming substrate after the completion of product, when the nozzle plate in the regions opposite the manifolds is continuously pushed by the projections.

It will be noted the abovementioned problems exist not only in the ink jet recording heads that eject ink droplets, but also in any liquid ejecting heads that eject liquid droplets other than ink droplets.

SUMMARY

An advantage of some aspects of the invention is that it provides a liquid ejecting head and a liquid ejecting apparatus capable of preventing delamination of a nozzle plate which is bonded to a flow channel forming substrate.

According to a first aspect of the invention, a liquid ejecting head includes a plurality of head bodies each having a nozzle plate in which a plurality of nozzles are formed by drilling, a flow channel forming substrate having a plurality of pressure generating chambers that communicate with the plurality of nozzles and a manifold that communicates with the plurality of pressure generating chambers, and pressure generating means that applies a pressure to the plurality of pressure generating chambers so as to allow ink droplets to be ejected, and a fixation plate having an exposure aperture formed so that the plurality of nozzles are exposed therethrough and on which the plurality of head bodies are fixedly positioned, wherein the edges of the exposure aperture formed on the fixation plate are located in a region opposite the manifold, and a depression is formed on a side of the fixation plate facing the nozzle plate by depressing the edges of the exposure aperture in the region opposite the manifold. Accordingly, the nozzle plate in the region opposite the manifold is not subjected to a force from the fixation plate. Therefore, delamination of the nozzle plate caused by the force can be prevented.

Preferably, according to the above aspect of the invention, the nozzle plate is made of a metallic material, and the depression is formed on the edges of the exposure aperture only in the region opposite the manifold. Accordingly, electrical conduction between the nozzle plate and the fixation plate can be relatively easily provided on the edges of the exposure aperture except for the region corresponding to the depression.

Preferably, according to the above aspect of the invention, a chamfer is formed on a side of the fixation plate opposite to the side facing the nozzle plate by chamfering the edges of the exposure aperture. Accordingly, a problem during cleaning such as a cleaning blade for wiping the surface of the nozzle plate being caught by the fixation plate can be eliminated.

Preferably, according to the above aspect of the invention, the depression is filled with an adhesive for adhering the plurality of head bodies and the fixation plate, or alternatively, a water repellent film is provided in the depression. Accordingly, it is possible to prevent the liquid ejected through the nozzles from being deposited in the depression, and prevent the target ejection medium from being contaminated by the liquid deposited in the depression.

Further, according to a second aspect of the invention, a liquid ejecting apparatus includes the liquid ejecting head according to the first aspect of the invention. Accordingly, the liquid ejecting apparatus having improved durability and reliability can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
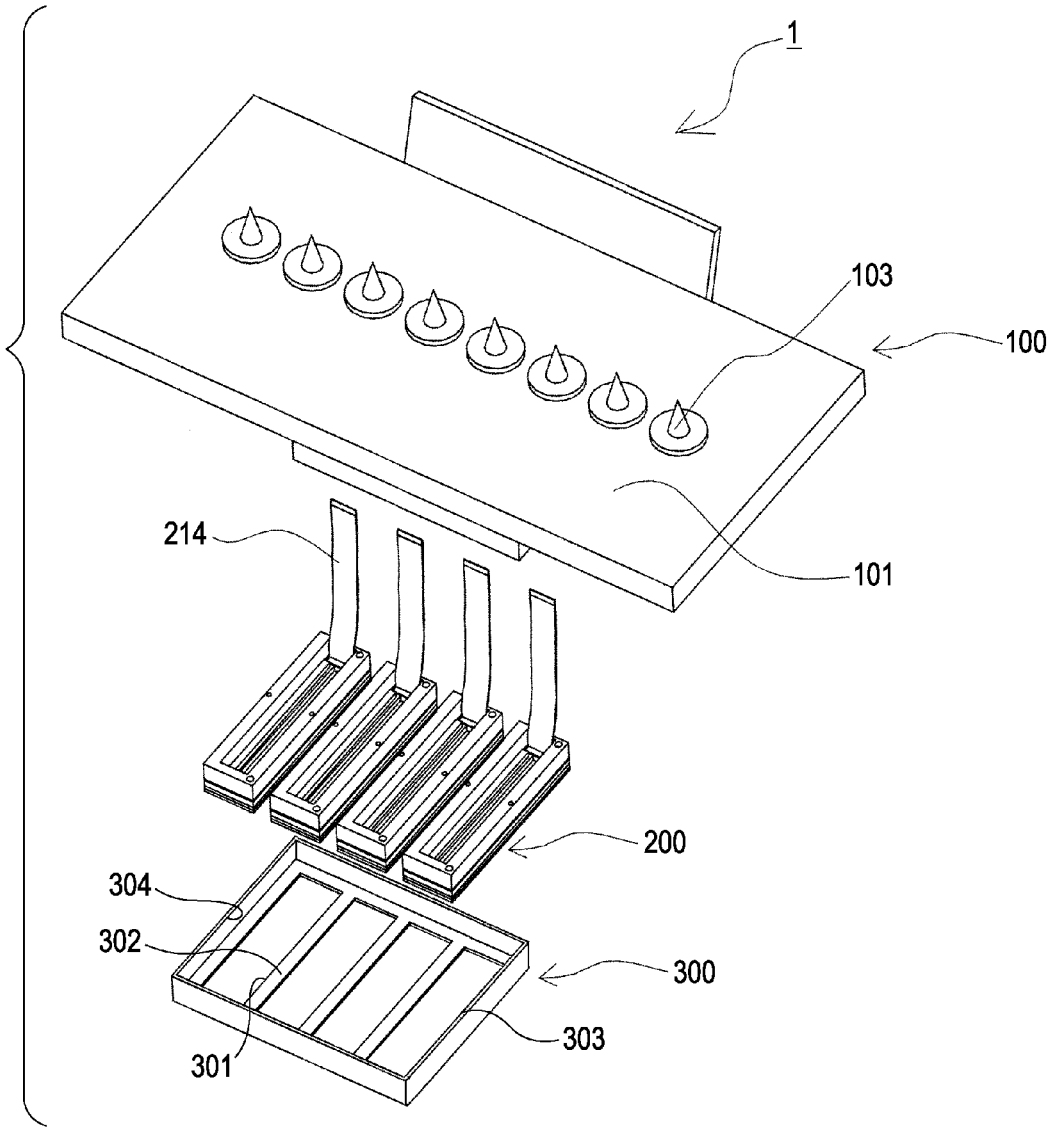
FIG. 1 is an exploded perspective view of a recording head according to one embodiment of the present invention.
Figure 2:
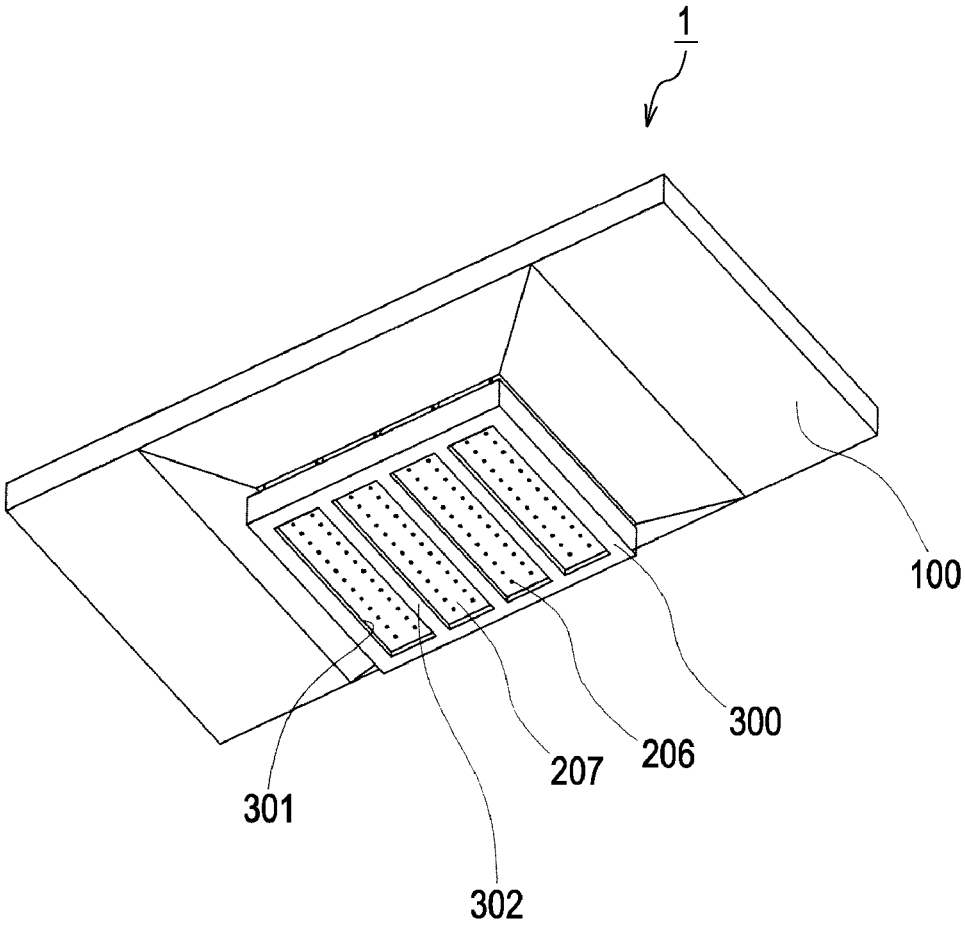
FIG. 2 is an assembly perspective view of the recording head according to one embodiment of the present invention.
Figure 3:
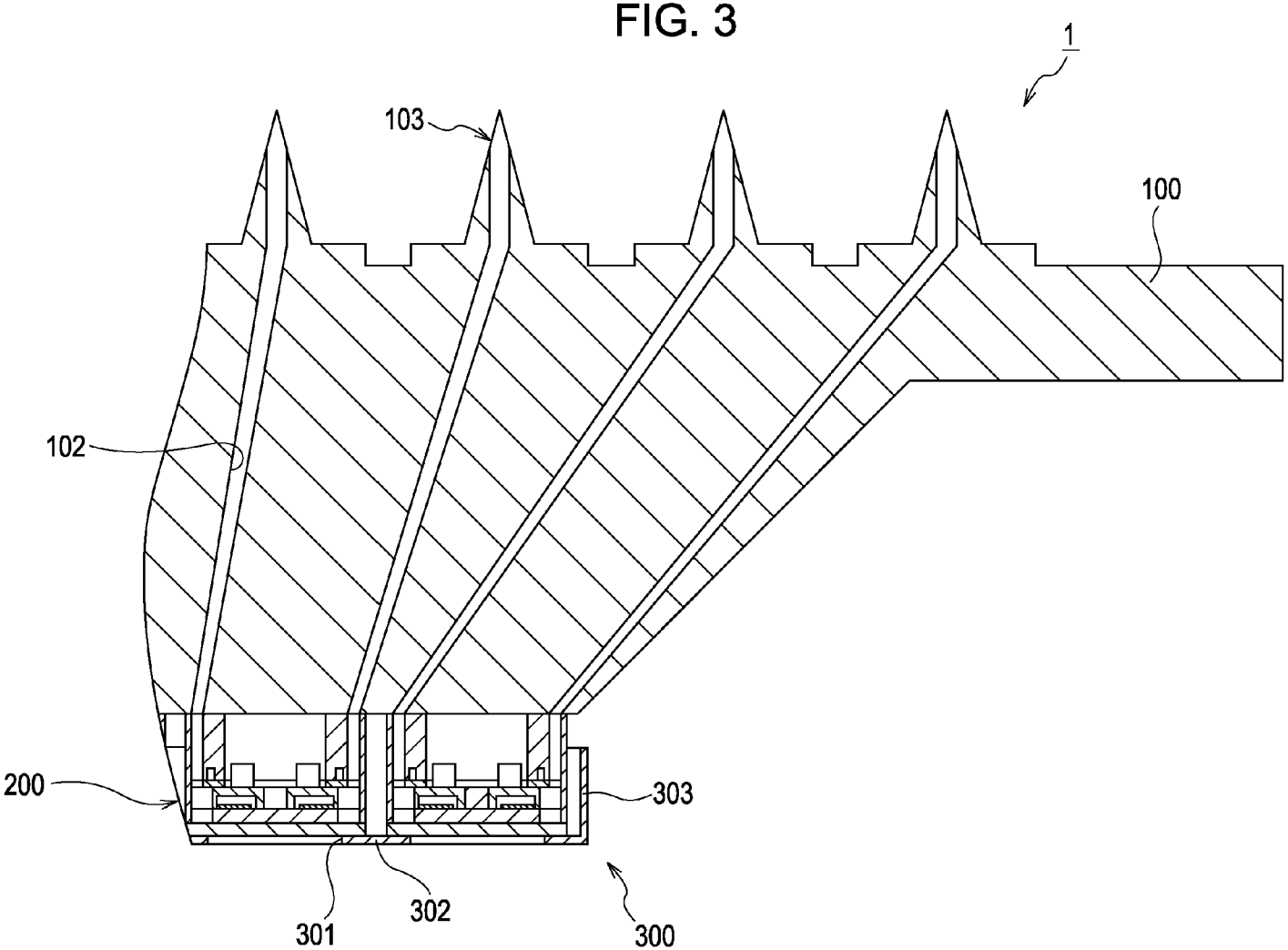
FIG. 3 is a sectional view of an essential portion of the recording head according to one embodiment of the present invention.

The present invention will be described below in detail according to an embodiment thereof. FIG. 1 is an exploded perspective view of a recording head according to one embodiment of the invention. FIG. 2 is an assembly perspective view of the recording head, and FIG. 3 is a sectional view of an essential portion of the recording head.

As illustrated, an ink jet recording head 1 (hereinafter simply referred to as "recording head") as an example of a liquid ejecting head includes a cartridge case 100, an ink jet recording head body 200 (hereinafter simply referred to as "recording head body") and a fixation plate 300 on which a plurality of recording head bodies 200 are fixedly positioned.

The cartridge case 100 is provided with cartridge mounting members 101, for example made of a resin material, on which ink cartridges (not shown) containing respective colors of ink are to be mounted. Further, a plurality of ink communication paths 102 which are open to the respective cartridge mounting members 101 at one end and to the recording head bodies 200 at the other end are provided on the bottom of the cartridge case 100. Further, ink supply needles 103, which are adapted to be inserted into the ink cartridges, are fixed on the respective cartridge mounting members 101 at the openings of the ink communication paths 102.

A plurality of (for example, four) recording head bodies 200 are positioned spaced apart from each other at predetermined intervals and fixed to the bottom of the cartridge case 100. The recording head bodies 200 are disposed so that each corresponds to each color of ink, and bonded to the fixation plate 300, thereby being secured on the bottom of the cartridge case 100 while being positioned relative to each other.

Figure 4:
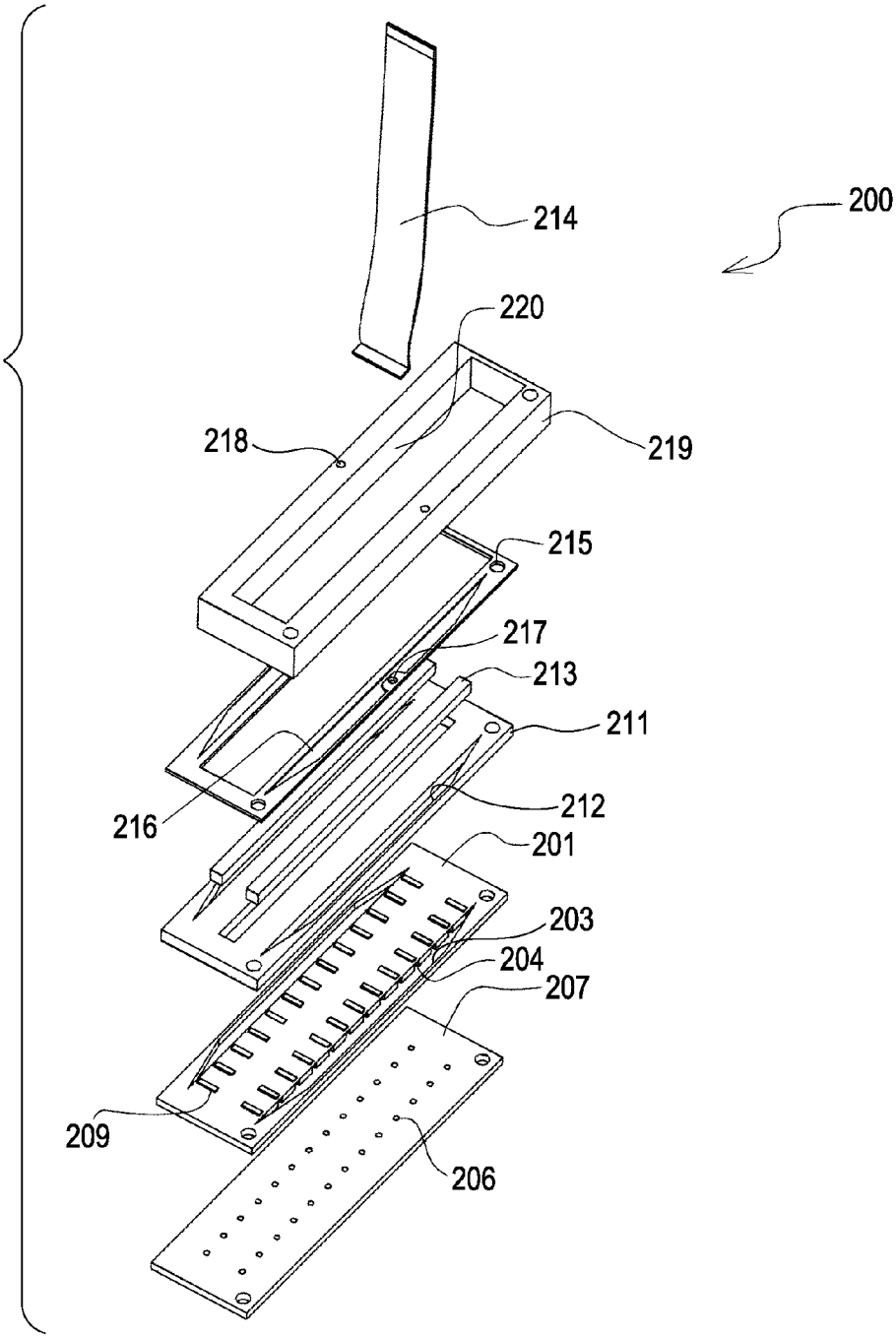
FIG. 4 is an exploded perspective view of a recording head body according to one embodiment of the present invention.
Figure 5:
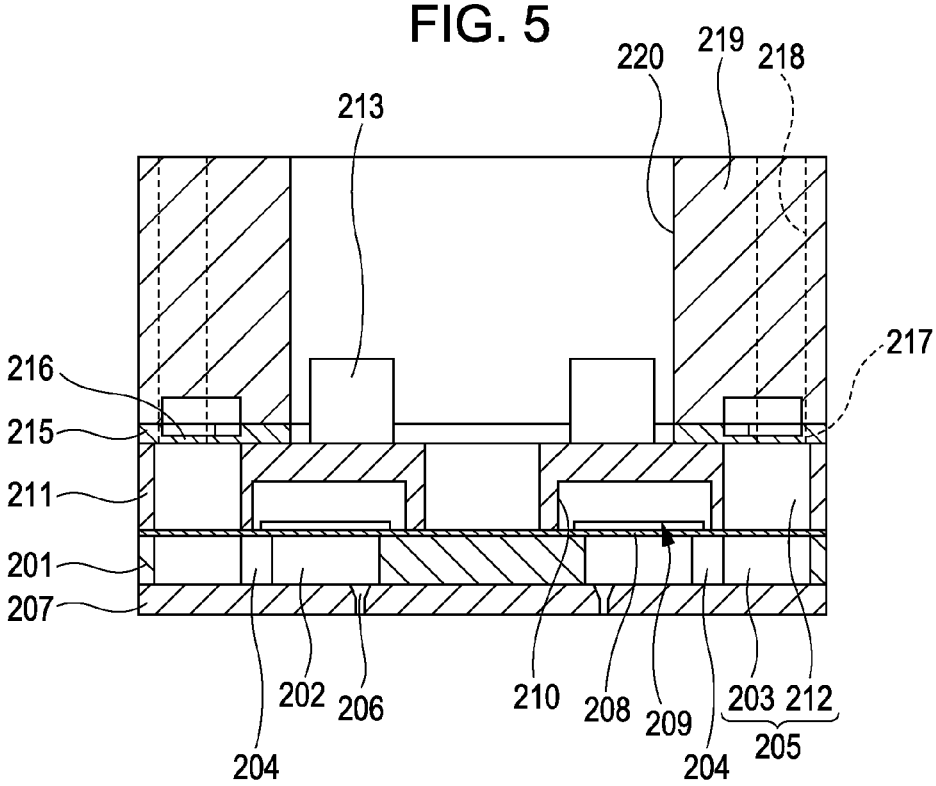
FIG. 5 is a sectional view of the recording head body according to one embodiment of the present invention.

The configuration of the recording head body 200 will be described below. FIGS. 4 and 5 are an exploded perspective view and a sectional view of the recording head body 200, respectively.

As shown in FIGS. 4 and 5, a flow channel forming substrate 201 which constitutes the recording head body 200 is provided with a plurality of pressure generating chambers 202 which extend passing through the thickness of the flow channel forming substrate 201. For example, in this embodiment, two rows of the pressure generating chambers 202 are disposed side by side in the width direction on the flow channel forming substrate 201. Further, a communication section 203 is disposed on the outer side relative to each row of the pressure generating chambers 202 in the longitudinal direction of the pressure generating chamber (the direction orthogonal to the rows of the pressure generating chambers). The communication sections 203 are formed in a continuous manner in the regions corresponding to the plurality of pressure generating chambers 202 that constitute the respective rows. The pressure generating chambers 202 each communicate with communication sections 203 via ink supply passages 204, which are formed corresponding to the respective pressure generating chambers 202. The communication sections 203 communicate with manifold sections 212 formed in a protective substrate 211, which will be described later in detail, so that they constitute manifolds 205 which serve as common ink chambers for the respective pressure generating chambers 202.

One side of the flow channel forming substrate 201 is attached to a nozzle plate 207, in which a plurality of nozzles 206 are formed by drilling so as to communicate with the respective pressure generating chambers 202. A material for the nozzle plate 207 includes, but is not limited to, a stainless steel (SUS) in this embodiment. The other side of the flow channel forming substrate 201 is provided with an elastic film 208. In this embodiment, the flow channel forming substrate 201 is made of a silicon substrate and the elastic film 208 is made of silicon oxide. On the elastic film 208, piezoelectric elements 209 are disposed as pressure generation means that apply pressure into the pressure generating chambers 202 so as to allow ink droplets to be ejected through the nozzles 206. The piezoelectric element 209 is composed of, although not shown in the figures, lower electrodes provided on the elastic film 208, a piezoelectric layer and upper electrodes.

In order to protect such piezoelectric elements 209 which are provided on the flow channel forming substrate 201, the protective substrate 211 having piezoelectric element holding sections 210 is bonded to the flow channel forming substrate 201. The protective substrate 211 is provided with the manifold sections 212 which communicate with the communication sections 203 in the flow channel forming substrate 201. As mentioned above, the manifold section 212 and the communication section 203 form the manifold 205 which serves as a common ink chamber for the respective pressure generating chambers 202.

On the protective substrate 211, drive ICs 213 for driving the respective piezoelectric elements 209 are mounted. Terminals of the drive IC 213, which are not shown, are connected to lead electrodes led out from individual electrodes of the respective piezoelectric elements 209 via bonding wires or the like. Further, the terminals of the drive IC 213 are connected to external wiring 214 such as a flexible print cable (FPC), as shown in FIG. 4, such that various signals such as printing signals are supplied to the terminals via the external wiring 214.

A compliance substrate 215 in which flexible sections 216 are formed in the regions corresponding to the manifolds 205 is bonded to the protective substrate 211. The flexible section 216 has a wall thinner than that of the remaining region of the compliance substrate 215 so that a variation in pressure in the manifold 205 is absorbed by the deformation of the flexible section 216. Further, the compliance substrate 215 is provided with ink introduction paths 217 which communicate with the manifolds 205.

A head case 219 in which ink supply communication paths 218 are formed is bonded to the compliance substrate 215. The ink supply communication path 218 communicates with the ink introduction path 217 at one end and the ink communication path 102 of the ink cartridge case 100 at the other end. Ink is supplied to the manifolds 205 via the ink communication paths 102, the ink supply communication path 218 and the ink introduction paths 217. Further, the head case 219 has a drive IC holding section 220 passing through the depth thereof in the region opposite the drive ICs 213. The drive IC holding section 220 is filled with a potting material, which is not shown, so as to cover the drive ICs 213.

In the recording head body 200 with the above described configuration, the regions from the manifolds 205 to the nozzles 206 are filled with ink. Then, a voltage is applied to the respective piezoelectric elements 209 corresponding to the pressure generating chambers 202 in response to the signals from the drive ICs 213 so as to flexibly deform the elastic film 208 together with the piezoelectric elements 209, applying a pressure to the ink in the respective pressure generating chambers 202, thereby allowing ink droplets to be ejected through the nozzles 206.

In the recording head 1, a plurality of (in this embodiment, four) recording head bodies 200, which are spaced apart from each other at predetermined intervals, are fixed to the fixation plate 300. The fixation plate 300 is provided with exposure apertures 301 corresponding to the recording head bodies 200 so that the nozzles 206 are exposed therethrough. That is, the fixation plate 300 has beams 302 corresponding to the regions between the respective recording head bodies 200, since the exposure apertures 301 corresponding to the respective recording head bodies 200 are formed (see FIG. 2). The respective recording head bodies 200 on the sides of the nozzle plates 207 are bonded to the fixation plate 300 having the beams 302 using an adhesive. The beams 302 of the fixation plate 300 prevent ink from infiltrating between the recording head bodies 200. Moreover, the beams 302 provide the areas for bonding around the respective nozzle plates 207 of the recording head bodies 200, allowing the respective recording head bodies 200 to be securely fixed to the fixation plate 300.

On the periphery of the fixation plate 300, side walls 303 are formed. That is, the fixation plate 300 according to this embodiment is formed in an approximate box shape which opens at one side and has a space 304 defined by the side walls 303 (see FIG. 1). The recording head bodies 200 are bonded to the fixation plate 300 with the nozzle plates 207 facing the bottom of the space 304.

Figure 6:
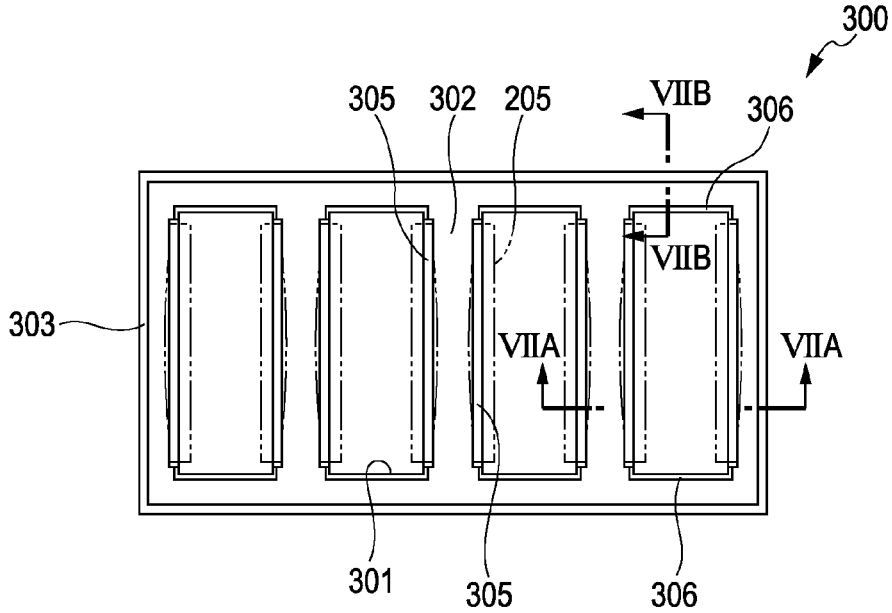
FIG. 6 is a plan view of a fixation plate according to one embodiment of the present invention.
Figure 7A:
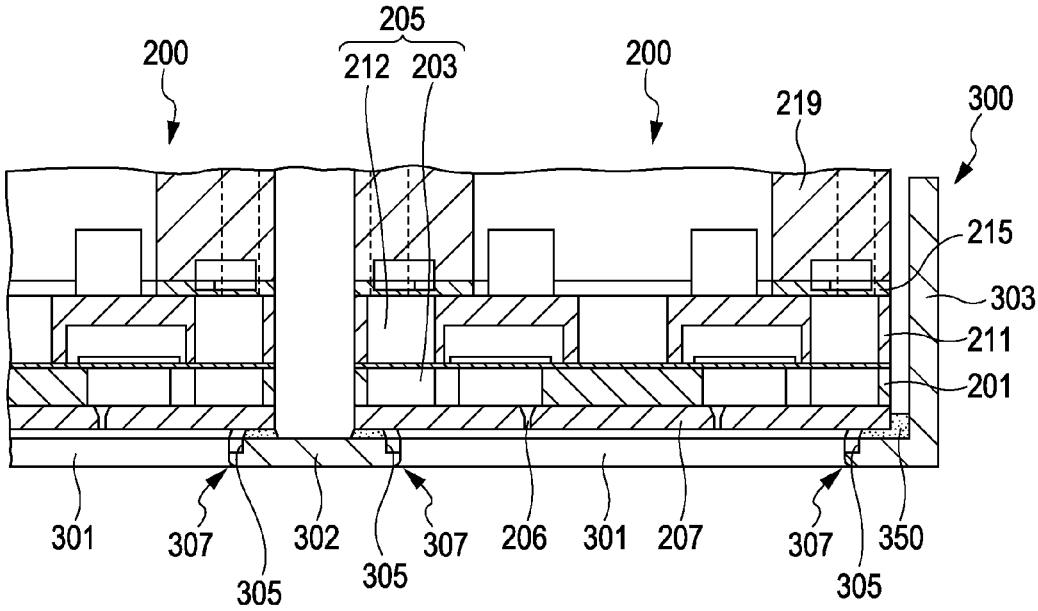
FIGS. 7A and 7B are sectional views of the recording head according to one embodiment of the present invention.
Figure 7B:
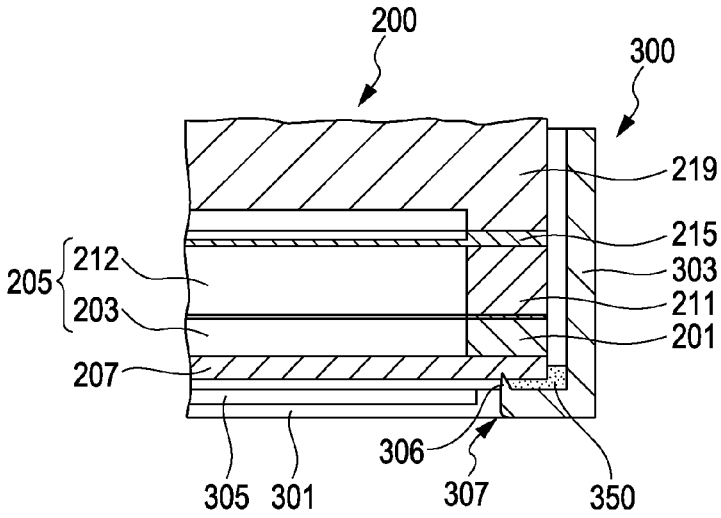

FIG. 6 is a plan view of the fixation plate and FIGS. 7A and 7B are sectional views of the recording head of FIG. 6 along the lines VIIA-VIIA and VIIB-VIIB, respectively.

The peripheries of the exposure apertures 301 in the fixation plate 300 are located in the regions opposite the communication sections (manifolds) formed in the flow channel forming substrates 201, as shown in FIGS. 6 and 7. Further, on the side of the fixation plate 300 facing the nozzle plate 207, depressions 305 are formed by depressing the edges of the exposure apertures 301 in the regions opposite the manifolds 205. In this embodiment, the depressions 305 are formed only in the regions opposite the manifolds 205 instead of over the whole periphery of the edges of the exposure aperture.

The projections 306 which protrude toward the nozzle plate 207 are formed on the edges of the exposure apertures 301 of the fixation plate 300 except for the regions corresponding to the depressions 305. For example, in this embodiment, the projections 306 are formed on the edges of the exposure apertures 301 in the direction of the nozzle rows. The exposure apertures 301 in the fixation plate 300 are formed by stamping the fixation plate 300, for example in press working. During the stamping, so-called burrs are produced as the projections 306 on the edges of the exposure apertures 301.

The depressions 305 are formed by stamping the fixation plate 300 to form the exposure aperture 301, and then by pressing the fixation plate 300. During the pressing, the projections 306 are collapsed, therefore no projections 306 are formed within the depression 305. Moreover, since the exposure apertures 301 are formed by stamping, the edges of the exposure apertures 301 on the side opposite to the side facing the nozzle plate 207 are chamfered to form chamfers 307. That is, the chamfers 307 are formed by making the edges of the exposure apertures 301 droop during stamping of the exposure apertures 301.

When the nozzle plates 207 of the recording head bodies 200 are adhered to the fixation plate 300 using an adhesive 350, the projections 306 on the fixation plate 300 engage with the nozzle plates 207 in the regions outside the manifolds (communication sections). As a result, the nozzle plates 207 become electrically connected to the fixation plate 300. Therefore, static electricity accumulated in the nozzle plates 207 can be successfully discharged via the fixation plate 300.

On the other hand, since the depressions 305 are formed on the edges of the exposure apertures 301 in the regions opposite the manifolds 205, the nozzle plates 207 do not abut the projections 306 in the regions opposite the manifolds 205. As a result, the nozzle plates 207 in the regions opposite the manifolds 205 are not subjected to a force acting toward the inside of the manifolds 205 from the fixation plate 300, and the nozzle plates 207 in the regions outside the regions where they oppose the manifolds are not subjected to a force in the opposite direction. Therefore, it is possible to prevent the nozzle plate 207 from being delaminated from the flow channel forming substrate 201.

Figure 8A:
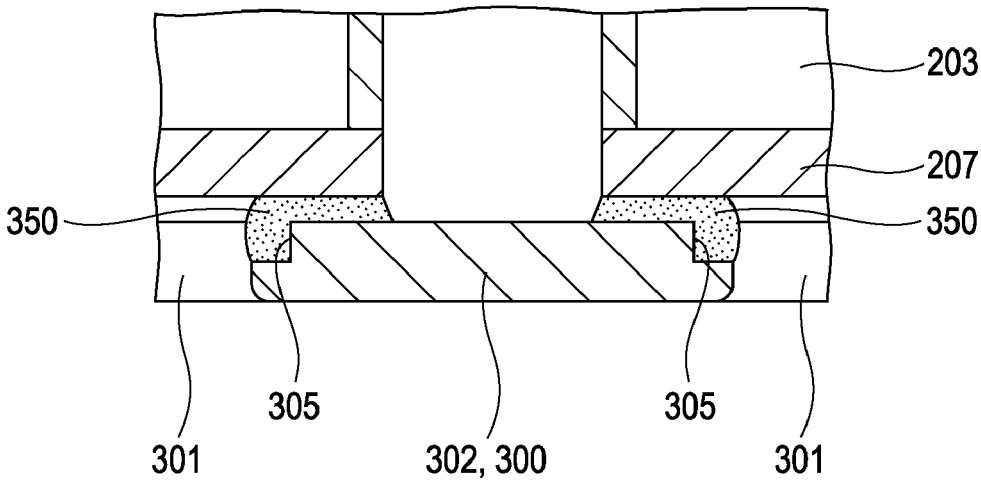
FIGS. 8A and 8B are sectional views showing a variation of the recording head according to one embodiment of the present invention.
Figure 8B:
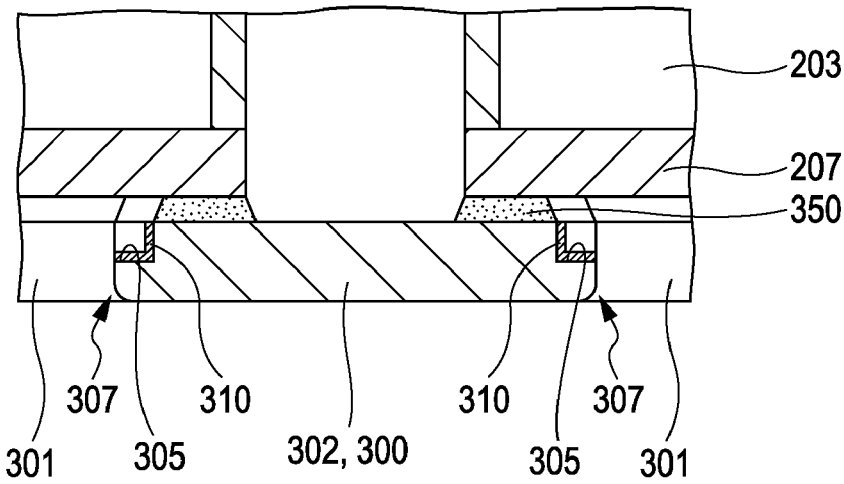

Further, as shown in FIG. 8A, the inside of the depression 305 of the fixation plate 300 may be filled with the adhesive 350 for adhering the recording head bodies 200 and the fixation plate 300. Alternatively, as shown in FIG. 8B, a water repellent film 310 formed of a material having a water repellent property (ink repellent property) may be provided on the surface in the depression 305. With this configuration, it is possible to prevent ink mist generated when ejecting ink droplets through the nozzles from being deposited in the depression 305.

Figure 9:
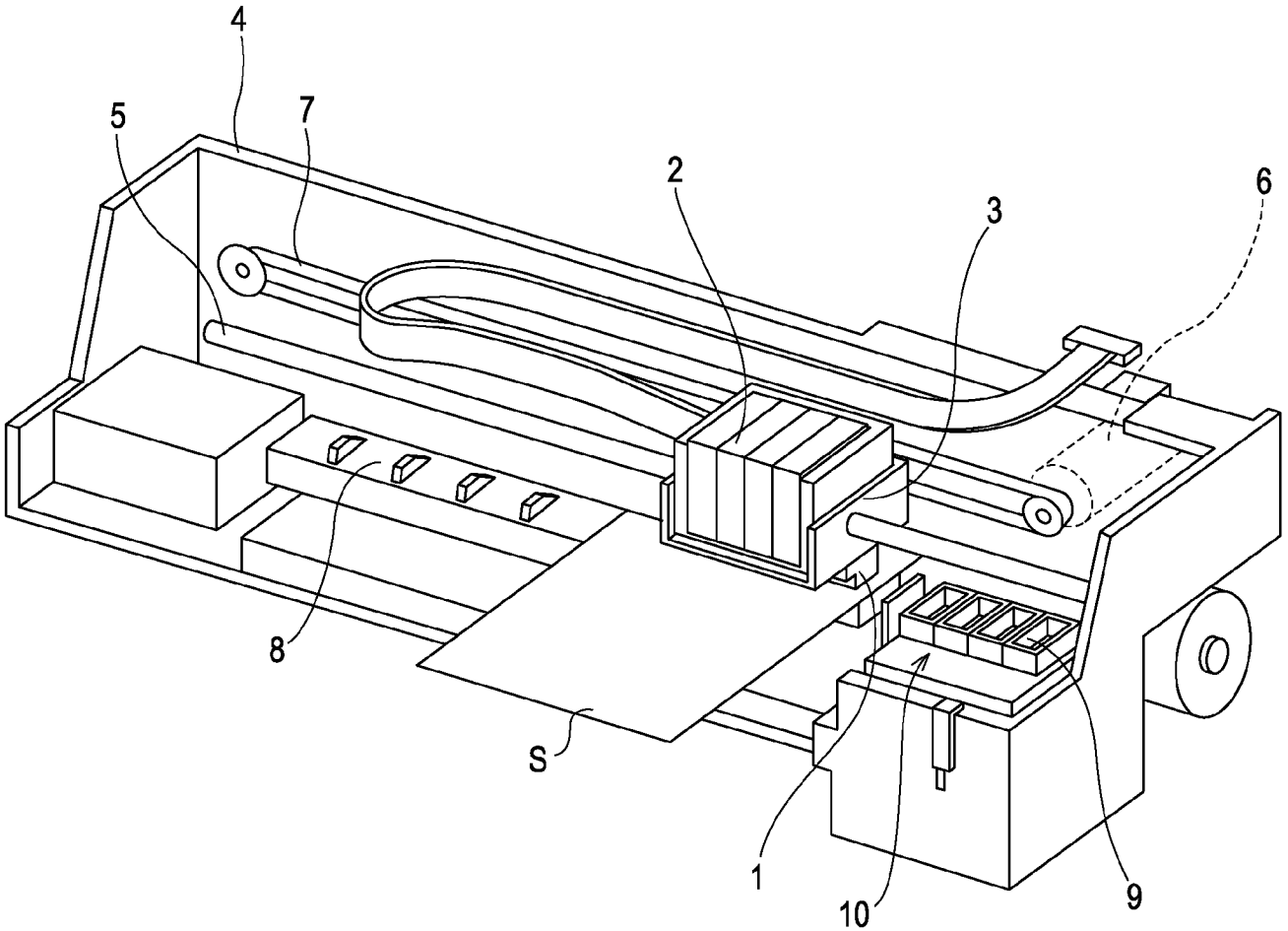
FIG. 9 is a schematic perspective view of a recording head according to one embodiment of the present invention.

The recording head 1 having such a configuration is mounted in the ink jet recording apparatus. FIG. 9 is a schematic perspective view showing one example of the ink jet recording apparatus. As shown in FIG. 9, the recording head 1 having the recording head bodies is mounted on a carriage 3, with cartridges 2 which constitute ink supplying means being removably attached thereto. The carriage 3 with the recording head 1 is mounted on a carriage shaft 5 disposed in the apparatus body 4 in a manner slidably movable in an axial direction of the carriage shaft 5. Then, the carriage 3 with the recording head 1 being mounted thereon is slidably moved on the carriage shaft 5, when a drive force from a drive motor 6 is transmitted to the carriage 3 via a plurality of gears and timing belts 7, which are not shown. In addition, a platen 8 is disposed in the apparatus body 4 along the carriage shaft 5, such that a recording sheet S, which is a recording medium such as a sheet of paper, is transported on the platen 8 by feeding means such as rollers, which are not shown.

Further, at the position corresponding to the home position of the carriage 3, that is, in proximity of one end of the carriage shaft 5, cap members 9 are disposed which seal the nozzle surfaces of the recording head 1 where the nozzles are open. The cap members 9 are connected to suction means (not shown) that performs a suctioning operation on the inside of the cap members 9. In this embodiment, a plurality of (four) cap members 9 are disposed corresponding to each of the abovementioned recording head bodies 200. The cap members 9 work to prevent ink in proximity of the nozzles in the recording head 1 from being dried by sealing the nozzle surfaces of the recording head bodies 200, and also serve as an ink receptacle during a suctioning operation of the suction means, for example, by a flushing operation for ejecting ink droplets through the nozzles, or suctioning ink or the like inside the cap members 9 to purge the nozzles at a predetermined timing.

In sealing the nozzle surfaces of the respective recording head bodies 200 which constitute the recording head 1 by means of the abovementioned cap members 9, certain spaces between the respective recording head bodies 200 need to be provided so as to allow the cap members 9 to abut thereon. In this embodiment, the cap members 9 are adapted to abut the beams 302 of the fixation plate 300 which are included in the nozzle surfaces of the recording head bodies 200, relatively wide beams 302 need to be provided. As described above, according to this invention, the edges of the exposure apertures 301 formed in the fixation plate 300 are placed in the regions opposite the manifolds 205 and relatively wide beams 302 are provided. Therefore, a good sealing of the nozzle surfaces of the respective recording head bodies 200 can be achieved, when the cap members 9 are disposed corresponding to the recording head bodies 200.

Further, a cleaning blade 10 for cleaning (wiping) the nozzle surfaces of the recording head 1 is disposed adjacent to the cap members 9. The carriage 3 is moved at a predetermined timing so that the end of the cleaning blade 10 is slidably brought into contact with the nozzle surfaces of the recording head 1, thereby performing a cleaning operation to wipe the nozzles surfaces (the surfaces of the nozzle plates 207). When the exposure apertures 301 of the fixation plates 300 are small, a good wiping of the surfaces of the nozzle plates 207 by the cleaning blade 10 may not be achieved. However, in this invention, the edges of the exposure apertures 301 formed in the fixation plate 300 are placed in the regions opposite the manifolds 205 as described above, and the exposure apertures 301 which are relatively wide are provided. Therefore, a good wiping of the surfaces of the nozzle plates 207 by the cleaning blade 10 may be achieved. In addition, according to this embodiment, the chamfers 307 are formed on the edges of the exposure apertures 301 as described above, so as to prevent the cleaning blade 10 from being caught by the fixation plate 300, therefore a good cleaning operation can be performed.

Although the embodiment of invention has been described, the invention is not limited to the above embodiment. For example, in the above embodiment, the depressions are formed on part of the edges of the exposure apertures and the projections are formed in the remaining area of the edges of the exposure apertures in the fixation plate. However, the fixation plate is not limited to the above configuration. For example, projections may not be necessarily formed, or alternatively, depressions may be formed over the whole periphery of the exposure apertures. In such configurations, it is preferable to electrically connect the nozzle plates to the fixation plate at any other positions so that static electricity on the nozzle plates can be discharged. For example, projections (so-called burrs) protruding toward the fixation plate may be formed on the outer circumferences of the nozzle plates, so that the nozzle plates are electrically connected to the fixation plate via the projections.

Further, in the above embodiment, no projections are formed within the depression since the depressions are formed by pressing the fixation plate. However, depressions having a certain height may be formed within the depression as long as they do not abut the nozzle plate.

Further, in the above embodiment, flexure vibration type of the piezoelectric elements are used as pressure generation means that apply a pressure to a liquid in the pressure generating chambers. However, the pressure generation means is not specifically limited to those piezoelectric elements. For example, vertical vibration type of the piezoelectric elements formed of piezoelectric materials and electrode forming materials that are alternatively stacked and configured to expand and contract in the axial direction, or heat generating elements and the like may be used.

Further, in the above embodiment, the invention has been described by means of an example of an ink jet recording head that ejects ink droplets, however the invention is intended to broadly cover any liquid ejecting heads. Such liquid ejecting heads include, for example, recording heads used for image recording apparatuses such as printers, color material ejecting heads used for manufacturing color filters for liquid crystal displays and the like, electrode material ejecting heads used for forming electrodes for organic electroluminescence displays, field emission displays (FEDs) and the like, and bioorganic ejection heads used for manufacturing biochips.

What is claimed is:

1. A liquid ejecting head comprising:

a head body having a nozzle plate in which a plurality of nozzles are formed by drilling, a flow channel forming substrate having a plurality of pressure generating chambers that communicate with the plurality of nozzles and a manifold that communicates with the plurality of pressure generating chambers, and a pressure generating element that applies a pressure to the plurality of pressure generating chambers so as to allow ink droplets to be ejected;

a fixation plate on which the head body is fixedly positioned; and an exposure aperture formed on the fixation plate in a region where the plurality of nozzles are located, wherein the nozzle plate is between the fixation plate and the manifold, and wherein a depression is formed on a side of the fixation plate facing the nozzle plate, the depression extending along at least a portion of an edge of the fixation plate facing the exposure aperture.

2. The liquid ejecting head according to claim 1, wherein the nozzle plate is made of a metallic material.

3. A liquid ejecting apparatus comprising the liquid ejecting head according to claim 2.

4. The liquid ejecting head according to claim 1, wherein a chamfer is formed on a side of the fixation plate opposite to the side facing the nozzle plate by chamfering the edges of the exposure aperture.

5. A liquid ejecting apparatus comprising the liquid ejecting head according to claim 3.

6. The liquid ejecting head according to claim 1, wherein the depression is filled with an adhesive for adhering the head body and the fixation plate.

7. A liquid ejecting apparatus comprising the liquid ejecting head according to claim 4.

8. The liquid ejecting head according to claim 1, wherein a water repellent film is provided in the depression.

9. A liquid ejecting apparatus comprising the liquid ejecting head according to claim 8.

10. A liquid ejecting apparatus comprising the liquid ejecting head according to claim 1.

11. The liquid ejecting head according to claim 1, wherein the nozzle plate and the fixation plate each comprise a metallic material, and wherein a projection is formed between the nozzle plate and the fixation plate in a region other than where the depression is present, the nozzle plate and the fixation plate being electrically connected via the projection.

12. A liquid ejecting apparatus comprising the liquid ejecting head according to claim 11.

* * * * *